US007942978B2

(12) United States Patent
Holzman et al.

(10) Patent No.: US 7,942,978 B2
(45) Date of Patent: May 17, 2011

(54) AUXILIARY RINSE PHASE IN A WASH MACHINE

(75) Inventors: Louis M. Holzman, St. Paul, MN (US); Adrian Hartz, Woodbury, MN (US); Eddie D. Sowle, Woodbury, MN (US); Lee J. Monsrud, Inver Grove, MN (US)

(73) Assignee: Ecolab Inc., St. Paul, MN (US)

( * ) Notice: Subject to any disclaimer, the term of this patent is extended or adjusted under 35 U.S.C. 154(b) by 1107 days.

(21) Appl. No.: 11/355,025

(22) Filed: Feb. 14, 2006

(65) Prior Publication Data

US 2007/0034234 A1 Feb. 15, 2007

Related U.S. Application Data

(60) Provisional application No. 60/708,684, filed on Aug. 15, 2005.

(51) Int. Cl.
*B08B 7/04* (2006.01)

(52) U.S. Cl. ..... 134/10; 134/18; 134/25.1; 134/26

(58) Field of Classification Search ..... 134/10, 134/25.1, 18, 32, 111, 110, 95.1, 95.2, 95.3, 134/56 R, 56 D, 57 R, 57 D, 58 R, 58 D, 134/96.1, 115 R, 183
See application file for complete search history.

(56) References Cited

U.S. PATENT DOCUMENTS 3,884,263 A * 5/1975 Wright ..... 137/571
4,439,242 A 3/1984 Hadden ..... 134/25.2
4,561,904 A * 12/1985 Eberhardt, Jr. ..... 134/18
4,810,306 A 3/1989 Noren ..... 134/25.2
4,861,385 A 8/1989 Yagishita ..... 134/10
4,872,466 A 10/1989 Noren ..... 134/57 D
5,031,650 A 7/1991 Nagata et al. ..... 134/111
5,194,095 A 3/1993 Yates ..... 134/10
5,259,889 A 11/1993 Payzant ..... 134/15
5,356,483 A 10/1994 Saalmann et al. ..... 134/25.2
5,429,679 A 7/1995 Young, Jr. ..... 134/25.2
5,507,877 A 4/1996 Magsig et al. ..... 134/18
5,617,885 A 4/1997 Centis ..... 134/58 D (Continued)

OTHER PUBLICATIONS

Definition of Rinse, Encarta.*

(Continued)

*Primary Examiner* — Michael Kornakov
*Assistant Examiner* — Eric Golightly
(74) *Attorney, Agent, or Firm* — Shumaker & Sieffert, P.A.

(57) ABSTRACT

A system and method are disclosed for cleaning articles within a chamber of a warewash machine. The warewash machine has a rinse sump for collecting a rinse agent dispensed into the chamber and a wash sump for collecting a wash agent dispensed into the chamber. The method includes a wash phase during which the wash agent is dispensed into the chamber during and an auxiliary rinse phase during which the rinse agent is dispensed into the chamber. The wash machine includes a controllable deflector for directing the wash agent to the wash sump during the wash phase and the rinse agent to the rinse sump during the auxiliary rinse phase. The method also includes a final rinse phase during which water from an external source is dispensed into the chamber. The controllable deflector direct the water dispensed during the final rinse phase to the rinse sump such that the water combines with the rinse agent therein. The rinse agent is re-used during at least one subsequent auxiliary rinse phase.

10 Claims, 6 Drawing Sheets

U.S. PATENT DOCUMENTS

| | | | | |
|---|---|---|---|---|
| 5,642,742 | A | 7/1997 | Noren et al. | 134/57 D |
| 5,794,634 | A | 8/1998 | Noren et al. | 134/57 D |
| 5,829,459 | A | 11/1998 | Milocco et al. | 134/57 D |
| 5,846,339 | A | 12/1998 | Masshoff et al. | 134/25.2 |
| 5,983,908 | A * | 11/1999 | Bradley | 134/57 D |
| 6,112,754 | A | 9/2000 | Bradley | 134/57 D |
| 6,302,123 | B1 * | 10/2001 | Wilson | 134/95.3 |
| 6,484,734 | B1 | 11/2002 | Everson et al. | 134/25.2 |
| 2001/0042557 | A1 * | 11/2001 | Moh | 134/10 |
| 2002/0117187 | A1 * | 8/2002 | Helminger | 134/18 |
| 2003/0037806 | A1 * | 2/2003 | McIntyre et al. | 134/18 |
| 2006/0237045 | A1 * | 10/2006 | Bigott | 134/56 D |
| 2006/0254618 | A1 * | 11/2006 | Cavallaro et al. | 134/18 |

OTHER PUBLICATIONS

Hobart C-Line Series Low Water Dual Rinse Product Literature, Hobart Corporation, 2001, 7 pages.

* cited by examiner

AUXILIARY RINSE PHASE IN A WASH MACHINE

RELATED APPLICATIONS

This application claims the benefit of priority to U.S. provisional patent application Ser. No. 60/708,684, filed Aug. 15, 2005.

TECHNICAL FIELD

The invention relates generally to a wash machine, and more particularly to application of an auxiliary rinse cycle therein.

BACKGROUND

A warewash machine is a utility dishwasher used in many restaurants, healthcare facilities and other locations to efficiently clean and sanitize cooking and eating articles, such as, dishes, pots, pans, utensils and other cooking equipment. Articles are placed on a rack and provided to a wash chamber of the warewash machine. In the chamber, cleaning products and rinse agents are applied to the articles during a cleaning process, which includes a wash phase and a rinse phase. At least one cleaning product is applied to the articles during the wash phase. The cleaning product is typically a cleaning agent formed by dissolving one or more chemical products in water. The term chemical product is used broadly to encompass, without limitation, any type of detergent, soap or any other product used for cleaning and/or sanitizing.

At least one rinse agent is applied to the articles during the rinse phase. The rinse agent is typically water with one or more wetting and/or sanitizing agents. The article racks contain holes that enable the cleaning product and rinse agent to pass through the racks during the wash and rinse phases, respectively. At the end of the cleaning process, the rack is removed from the wash chamber so that other racks carrying other articles may be moved into the wash chamber. The cleaning process is then repeated for each of these subsequent racks.

As with most natural resources, it is desirable in most warewash implementations to recycle the cleaning and rinse agents used during the wash and rinse phases, respectively, in order to save utility costs associated with the water used to form these agents. However, one drawback realized when recycling these agents is the drastic loss in temperature of the agents relative to various industry-defined standards. As known to those skilled in the art, these standards define minimum temperatures that may be employed during the phases of the cleaning process. Therefore, warewash implementations that recycle agents for use in the cleaning process also must employ booster heaters to heat both the cleaning agent and the rinse agent.

Unfortunately, many of the lower-end models of warewash machines, such as door-type machines, operate on standard 120 VAC, and therefore do not have the electrical capacity to employ the use of such booster heaters. For this reason, very few conventional door-type warewash machines use recycled cleaning and rinse agents, and consequently the operators of these machines commonly incur substantial water and sewage costs. Even so, the use of booster heaters yields considerably higher energy costs that, in most circumstances, would mitigate the savings realized by conserving water.

SUMMARY OF THE INVENTION

In accordance with the present invention, the above and other problems are solved by a method for cleaning articles within a wash chamber of a wash machine. The cleaning method includes a wash phase during which a wash agent is dispensed into the wash chamber, an auxiliary rinse phase during which an auxiliary rinse agent is dispensed into the wash chamber and a final rinse phase during which water is dispensed into the wash chamber. The auxiliary rinse agent is a mixture of the wash agent and water. The wash agent, which is formed from a combination of at least one chemical product and water, loosens soil and sanitizes any articles contained in the wash chamber. The wash phase occurs at a time during the cleaning process prior to the auxiliary rinse phase, and as such, the auxiliary rinse agent dispensed into the wash chamber during the auxiliary rinse phase washes off any soil and wash agent residue remaining on the articles after the wash phase. The rinse phase occurs at a time during the cleaning process after the auxiliary rinse phase, and therefore, finalizes the cleaning of any articles in the wash chamber by washing off any residue wash agent, soil and auxiliary rinse agent therefrom.

The wash machine has a rinse sump for collecting both the rinse agent dispensed into the wash chamber during the auxiliary rinse phase and the water dispensed into the wash chamber during the final rinse phase. The wash machine also includes a wash sump for collecting the wash agent dispensed into the wash chamber during the wash phase. During the wash phase, the method pumps the wash agent from the wash sump into the wash chamber. Likewise, the auxiliary rinse agent used during the auxiliary rinse phase is pumped to the wash chamber from the rinse sump. In contrast, the water provided to the wash chamber during the final rinse phase is provided to the wash machine from an external water source.

A sump deflector controllable by the method of the present invention directs the wash agent dispensed into the wash chamber to the wash sump and the rinse agent and water dispensed during the auxiliary rinse phase and the final rinse phase, respectively, to the rinse sump. As such, the wash agent, the rinse agent and the water dispensed during each of the various phases of the cleaning method are recycled for use in subsequent cleaning methods.

In accordance with another embodiment, the rinse sump comprises a first overflow drain into the wash sump and the wash sump comprises a second overflow drain into a discharge receptacle. The discharge receptacle is fluidly coupled to a sewage facility, septic tank or the like. The rinse agent overflows from the rinse sump into the wash sump via the first overflow drain. Likewise, the rinse agents and the wash agent overflow from the wash sump into the discharge receptacle via the second overflow drain. Therefore, as the wash machine is in operation and the wash agent, the auxiliary rinse agent and water are being diverted by the sump diverter into the wash sump and rinse sump, respectively, the present invention provides functionality for replenishing the sumps with fresh contents.

Embodiments of the invention may be implemented as a computer process, a computing system or as an article of manufacture such as a solid state, non-volatile memory device or a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

These and various other features as well as advantages, which characterize the present invention, will be apparent from a reading of the following detailed description and a review of the associated drawings.

DETAILED DESCRIPTION

Figure 1:
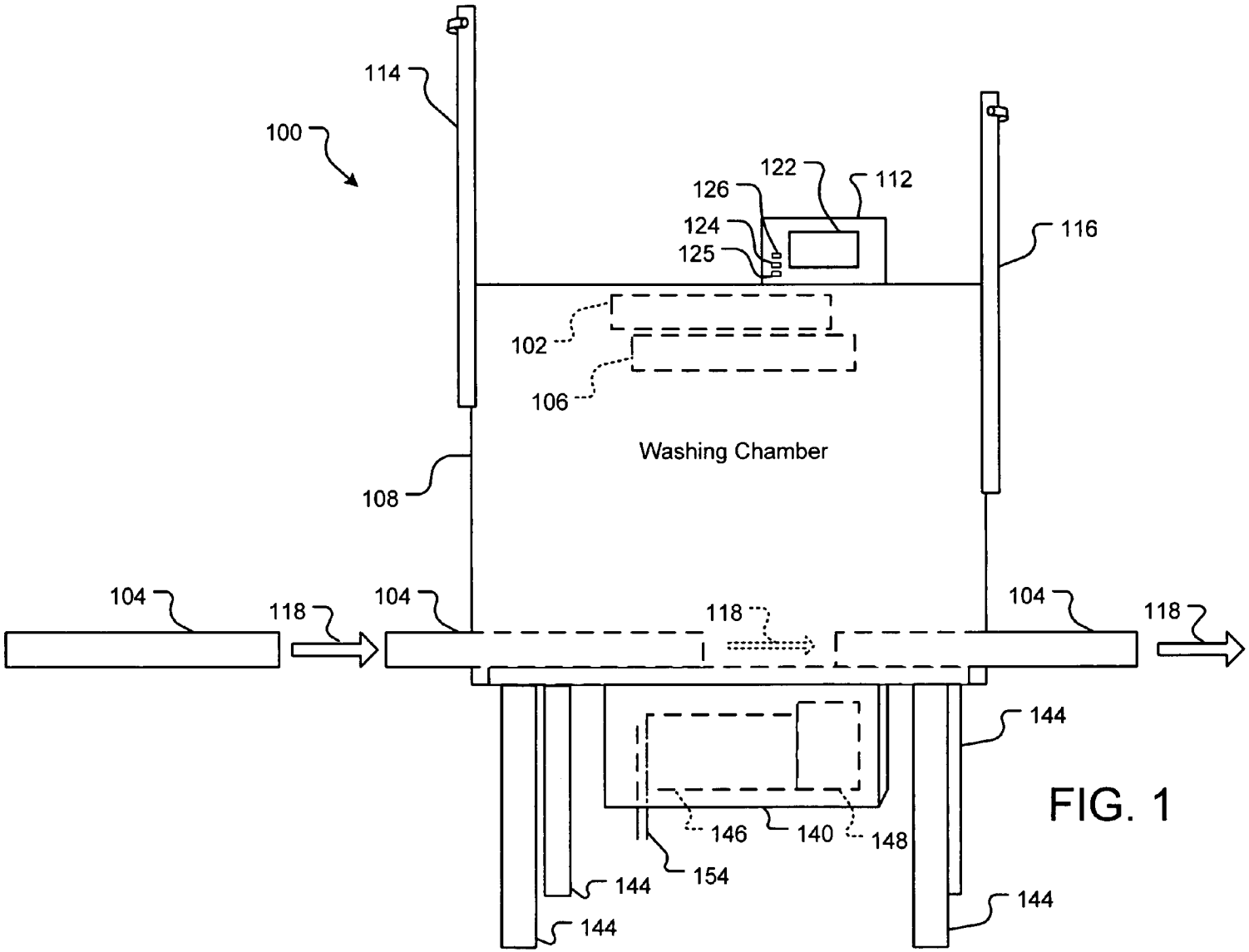
FIG. 1 illustrates components of a wash machine in accordance with an embodiment of the present invention.

The present invention and its various embodiments are described in detail below with reference to the figures. When referring to the figures, like structures and elements shown throughout are indicated with like reference numerals. Objects depicted in the figures that are covered by another object, as well as the reference annotations thereto, are shown using dashed lines.

The present invention generally relates to a wash machine and a process for cleaning articles placed therein. The process includes a wash phase, an auxiliary rinse phase and a final rinse phase. During the wash phase, the wash machine applies a cleaning agent to the articles. The cleaning agent cleans the articles by washing away or loosening soil deposited thereon. After the wash phase, the process continues with the auxiliary rinse phase during which the wash machine applies a first rinse agent (hereinafter, "auxiliary rinse agent") to the articles. The auxiliary rinse agent washes the cleaning agent and soil from the articles.

Following the auxiliary rinse phase, the process continues with a final rinse phase. During this final rinse phase, the wash machine applies a second rinse agent (hereinafter, "final rinse agent") to the articles for a time period sufficient enough to complete the washing process. The length of time that the wash phase, the auxiliary rinse phase and the final rinse phase are applied to the articles may be defined by any number of factors, including for example, a standards or regulatory organization. To illustrate, the National Standards Foundation (NSF) establishes minimum requirements for sanitizing dishes and wares within wash machines. These minimum requirements are measured in Heat Unit Equivalents (HUEs) and are defined as a function of temperature reached during the cleaning process and the length of time of the cleaning process.

The descriptions of the figures provided below illustrate in more detail embodiments of the present invention generally described above. While these descriptions focus on embodiments pertaining to warewash machines, it should be appreciated that the present invention pertains to other forms of wash machines, such as, for example, laundry machines.

Referring now to FIG. 1, an exemplary wash machine 100 is shown in accordance with an embodiment of the present invention. The exemplary wash machine 100 is a "warewash" machine that is used to clean various types of dishware and kitchen objects, such as, without limitation, pots and pans used in restaurants, cafeterias and bakeries. Objects washed by the warewash machine 100 are referred to herein as "articles." The articles are provided to the warewash machine 100 on article racks 104. The warewash machine 100 may be any type of warewash machine, such as, without limitation, a conveyor-type warewash machine, a flight-type warewash machine, a recirculating door-type warewash machine, or a commercial dump or fill-type dish machine.

The warewash machine 100 includes a wash chamber 108, which, in the embodiment shown in FIG. 1, is enclosed by an entry sliding door 114 and an exit sliding door 116. The wash chamber 108 is supported above ground level by a plurality of legs 144. In operation, each article rack 104 carries one or more articles to be washed by the warewash machine 100 into the wash chamber 108 through an opened entry sliding door 114. Arrows 118, which are provided in FIG. 1 for illustration purposes only, show the direction of article racks 104 through the wash chamber 108 in accordance with an embodiment of the present invention. Once an article rack 104 is located inside the wash chamber 108, the entry sliding door 114 and the exit sliding door 116 are both closed to fully contain the wash chamber 108 on all sides.

A wash module 106 is provided within or directly below the wash chamber 108 for applying the cleaning agent to articles in the racks 104 during the wash phase. As is known to those skilled in the art, the cleaning agent cleans the articles for subsequent use in eating, cooking or otherwise utilizing. In accordance with an embodiment of the invention, the wash module 106 also applies the auxiliary rinse agent to the articles in the racks 104 during the auxiliary rinse phase. A rinse module 102 is provided within or directly above the wash chamber 108 for applying the final rinse agent to articles in the article racks 104 during the final rinse phase. Although water is hereinafter described as the exemplary final rinse agent, it should be appreciated that the water may include wetting agent(s) and/or sanitizing agent(s) dissolved therein.

The rinse module 102 and the wash module 106 include arms (not shown) operably mounted to a spindle (not shown) for rotation about the spindle axis. The arms of the rinse module 102 include a plurality of openings (not shown) through which the final rinse agent is passed to articles placed in the wash chamber 108. Likewise, the arms of the wash module 106 include a plurality of openings (not shown) through which the cleaning agent and the auxiliary rinse agent are passed to articles placed in the wash chamber 108.

The cleaning agent is formed and stored in a wash sump 146 positioned underneath the wash chamber 108 in a sump compartment 140. The cleaning agent is formed as a combination of water and one or more chemical products, such as a detergent. For illustration purposes, and not by means of limitation, the cleaning agent is a combination of a single chemical product and water. The auxiliary rinse agent is formed and stored in an auxiliary rinse sump 148, which, in accordance with an embodiment of the present invention, is positioned adjacent to the wash sump 146 in the sump compartment 140. Like the final rinse agent, the auxiliary rinse agent is a water-based compound that may include wetting agent(s) and/or sanitizing agent(s) dissolved therein. Additionally, the auxiliary rinse agent may also include parts of the chemical product used to form the cleaning agent. Alternatively, the auxiliary rinse agent may be substantially formed of water without any wetting agents, sanitizing agents or chemical products dissolved therein.

The wash sump 146 and the auxiliary rinse sump 148 are open-ended containers situated upright in order to capture and hold liquid. That is, these containers include a bottom surface and four side surfaces (i.e., walls), but no upper surface. The height of the auxiliary rinse sump 148 is greater than the height of the wash sump 146 such that the auxiliary rinse agent contained in the auxiliary rinse sump 148 overflows into the wash sump 146. By overflowing into the wash sump 146, the auxiliary rinse agent is converted to cleaning agent. A drain 154 is positioned adjacent to the wash sump 146. The height of the drain 154 is less than the height of the wash sump 146 such that the cleaning agent contained in the wash sump 146 overflows into the drain 154. The drain 154 is fluidly connected to a receptacle for communicating fluids to a chemical waste system, such as a septic tank or sewer.

In an embodiment of the present invention, various operations of the warewash machine 100 are controlled and monitored by a warewash controller 112. The warewash controller 112 performs operations stored as firmware or software to control and monitor various tasks administered by the warewash machine 100 during operation. For example, in response to detecting initiation of a wash phase for each rack 104 provided to the warewash machine 100, the controller 112 controls dispensing of the chemical product to the wash sump 146 to formulate the cleaning agent. To accomplish this, the warewash controller 112 measures using a sensor (not shown) the current conductivity of the cleaning agent resident in the wash sump 146, and based on this measurement, controls the amount of the chemical product dispensed to the wash sump 146. The controller 112 also controls initiation and operation of the wash module 106 and the rinse module 102 during operation of the warewash machine 100. As such, the controller 112 is responsible for controlling the dispensing of the cleaning agent, the auxiliary rinse agent and the final rinse agent to the wash chamber 108 for application to articles in the racks 104 placed therein. In an exemplary embodiment, the warewash controller 112 is a special-purpose programmable controller 112 manufactured by NOVA Controls. However, it should be appreciated that the warewash controller 112 may be any type or make of controller 112 known to those skilled in the art.

The warewash controller 112 is shown in FIG. 1 as being communicatively connected to one or more display devices or modules, such as, without limitation, first, second and third status indicators 124, 125 and 126, e.g., light emitting diodes (LED's), and a graphical user interface (GUI) 122. The GUI 122 is used to input commands into the controller 112. The GUI 122 provides a computer-assisted means through which operators can set up and deploy the warewash machine 100 into operation in an intended service environment, such as, for example, a restaurant, a hotel, etc. It should be appreciated that any conventional GUI (e.g., touch-screen interfaces, mouse-based interfaces, keyboard-based interfaces, etc.) may be programmed to implement embodiments of the present invention. Furthermore, the GUI 122 and the first, second and third status indicators 124, 125 and 126 provide operators with functionality to monitor operation of the warewasher 100 by displaying information relating to the various tasks that are controlled and monitored by the controller 112.

In an embodiment, the first, second and third status indicators 124, 125 and 126 indicate the current operation of the warewash machine 100. In this embodiment, the first status indicator 124 indicates to users that the warewash machine 100 is currently operating in the wash phase, the second status indicator 125 indicates to users that the warewash machine 100 is currently operating in the auxiliary rinse phase and the third status indicator 126 indicates to users that the warewash machine 100 is currently operating in the final rinse phase. It should be appreciated that the status indicators 124 and 125 may be used for any other purpose related to operating characteristics of the warewash machine 100.

Figure 2:
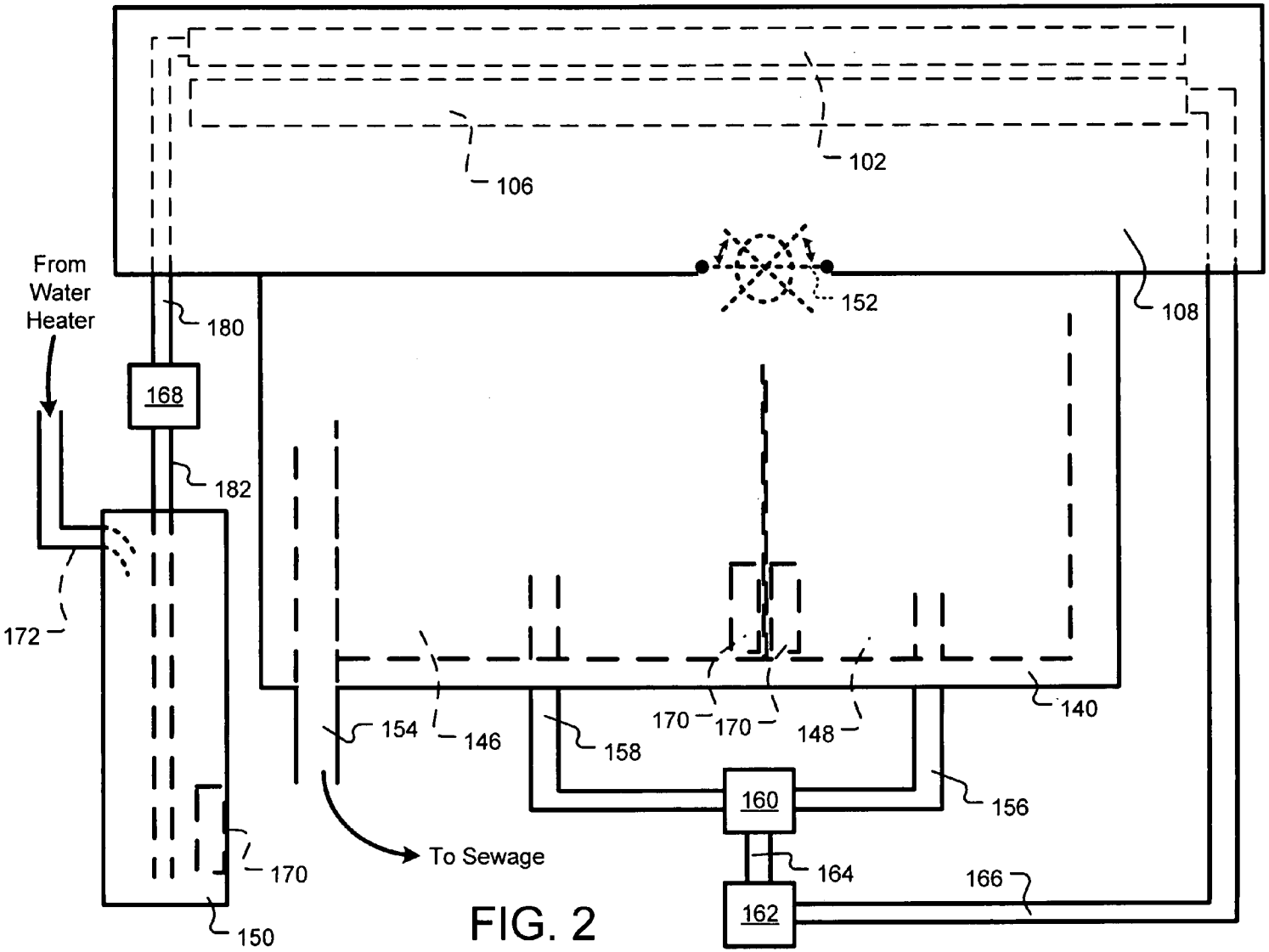
FIG. 2 illustrates in more detail various components of the wash machine shown in FIG. 1.

Referring now to FIG. 2, various components of the warewash machine 100 are described in greater detail in conjunction with the three phases of operation of the machine 100. In addition to those components introduced above in connection with FIG. 1, the warewash machine 100 also includes a sump diverter 152, a pump diverter 160, a wash arms pump 162, a final rinse sump 150 and a final rinse pump 168. In an embodiment, these components, like the rinse module 102 and wash module 106 described above, are also controlled by the controller 112 to effectuate performance of cleaning processes.

The sump diverter 152 is controllable by the controller 112 to direct the cleaning agent, the auxiliary rinse agent and the final rinse agent from the wash chamber 108 to either the wash sump 146 or the auxiliary rinse sump 148. During the wash phase, the controller 112 controls the sump diverter 152 such that the cleaning agent is directed to the wash sump 146. During the auxiliary rinse phase and the final rinse phase, the controller 112 controls the sump diverter 152 such that the auxiliary rinse agent and the final rinse agent are directed to the auxiliary rinse sump 148. In accordance with an embodiment of the present invention, the controller 112 may also control the sump diverter 152 such that the auxiliary rinse agent is directed to the wash sump 146 for an initial time period (e.g., the first 2-4 seconds) during the auxiliary rinse phase. Such an embodiment may be advantageous to minimize the amount of cleaning agent and soil in the auxiliary rinse sump 148 by directing this residue to the wash sump 146 immediately after completion of the wash phase.

The pump diverter 160 is controllable by the controller 112 to define whether the wash arms pump 162 can pump either the auxiliary rinse agent or the cleaning agent from the auxiliary rinse sump 148 or the wash sump 146, respectively, to the wash module 106 for application to the wash chamber 108. During the wash phase, the controller 112 controls the pump diverter 160 such that the flow of cleaning agent is enabled between the wash sump 146 and the wash arms pump 160. As such, in response to the controller 112 activating the wash arms pump 162 during initiation of the wash phase, the cleaning agent is extracted from the wash sump 146 and provided to the wash arms 106 by the wash arms pump 162. The cleaning agent flows from the wash sump 164 to the pump diverter 160 via a sump-diverter conduit 158 and through the pump diverter 160 to the wash arms pump 162 via a diverter-pump conduit 164. From the wash arms pump 162, the cleaning agent is provided to the wash module 106 via a pump-module conduit 166.

During the auxiliary rinse phase, the controller 112 controls the pump diverter 160 such that the flow of auxiliary rinse agent is enabled between the auxiliary rinse sump 148 and the wash arms pump 160. As such, in response to the controller 112 activating the wash arms pump 162 during the auxiliary rinse phase, the auxiliary rinse agent is extracted from the auxiliary rinse sump 148 and provided to the wash module 106 by the wash arms pump 162. The auxiliary rinse agent flows from the auxiliary rinse sump 148 to the pump diverter 160 via a sump-diverter conduit 156 and through the pump diverter 160 to the wash arms pump 162 via the diverter-pump conduit 164. From the wash arms pump 162, the auxiliary rinse agent is provided to the wash module 106 via the pump-module conduit 166.

The final rinse sump 150 stores the final rinse agent prior to application to the wash chamber 108 via the rinse module 102. The final rinse agent is provided to the final rinse sump 150 by way of an input conduit 172 that is fluidly connected to a water heater (not shown). As such, the final rinse agent is pre-heated to certain temperature based on the heating characteristics of the water heater. The final rinse pump 168 is controllable by the controller 112 to provide the final rinse agent contained in the final rinse sump 150 to the rinse module 102. In response to initiation of the final rinse phase, the final rinse pump 168 is activated to extract the final rinse agent from the final rinse sump 150 via a sump-pump conduit 182. From the final rinse pump 168, the final rinse agent is provided to the rinse module 102 via a pump-module conduit 180.

In accordance with an embodiment, each of the final rinse sump 150, the wash sump 146 and the auxiliary rinse sump 148 may contain a booster heater 170. The booster heaters 170 are operable to further heat the cleaning agent, the auxiliary rinse agent and the final rinse agent contained in the respective sumps 146, 148 and 150. It should be appreciated that these agents are pre-heated prior to being introduced into the respective sumps. However, such pre-heated temperatures may not be adequate for fully sanitizing articles in the wash chamber 108, thereby rendering the need to further heat these agents in order to meet the NSF standards described above. Use of a booster heater 170 in any of these sumps 146, 148 and 150 is optional and a matter of implementation. Indeed, the final rinse sump 150 may include a booster heater 170, while neither the wash sump 146 nor the auxiliary rinse sump 148 include such a heater 170. Alternatively, the auxiliary rinse sump 148 and the final rinse sump 150 may include a booster heater 170, while the wash sump 146 may not. Other combinations exist; however, for simplicity, a booster heater 170 is shown in FIG. 2 as being a constituent part of each of the sumps 146, 148 and 150.

Figure 3:
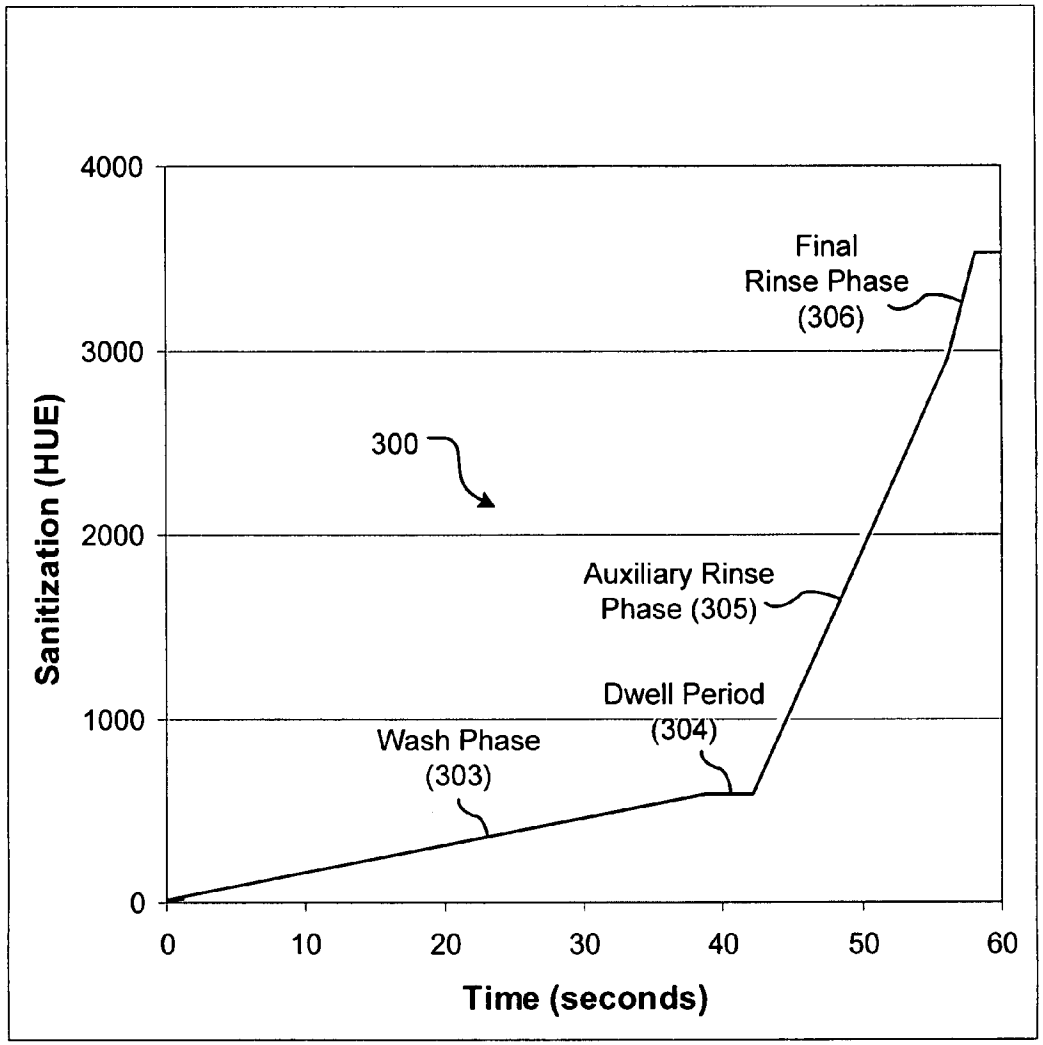
FIG. 3 is a graphical representation of different phases of operation of the wash machine of FIG. 1 in performance of a cleaning process in accordance with an embodiment of the present invention.
Figure 4:
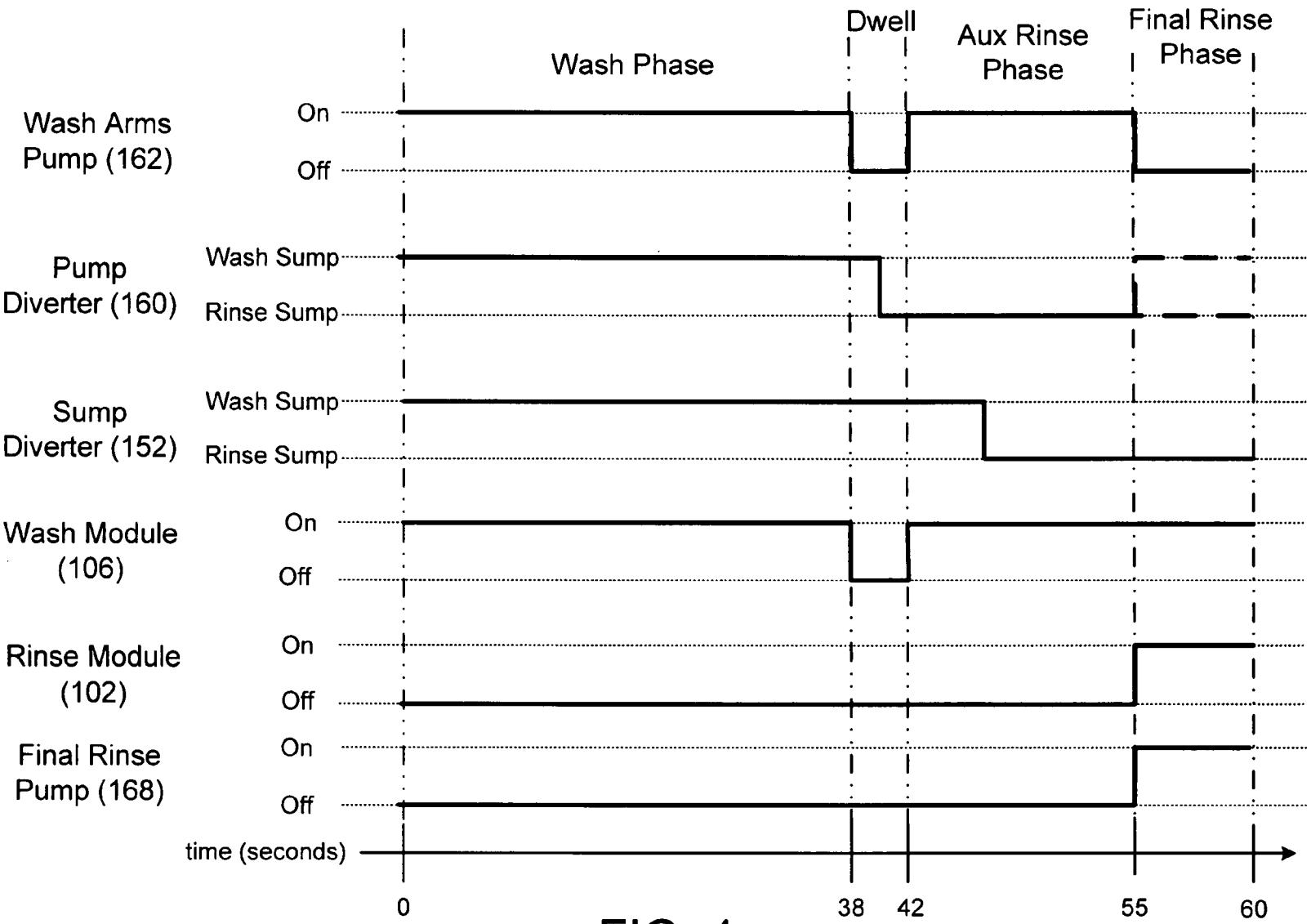
FIG. 4 is a timing diagram illustrating operational states of the various components of the wash machine shown in FIG. 2 relative to the different phases of the cleaning process illustrated in FIG. 3.
Figure 5:
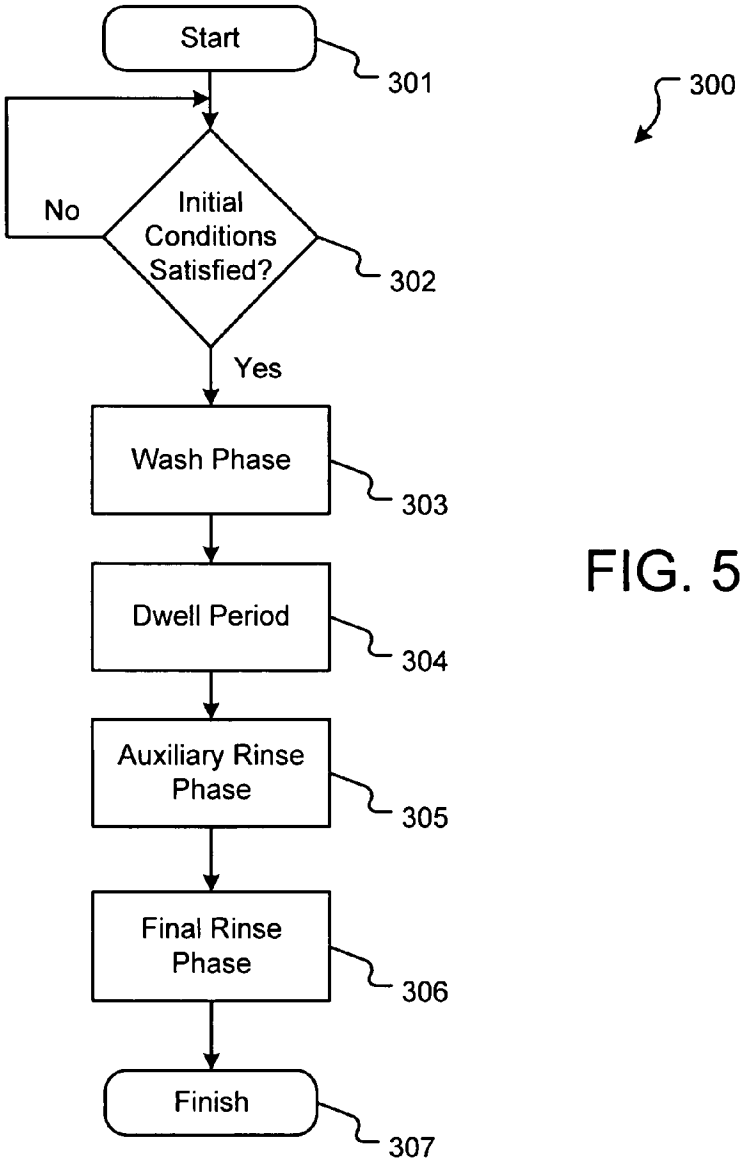
FIG. 5 is a flow diagram illustrating operational characteristics of the cleaning process illustrated FIGS. 3 and 4.

Referring now collectively to FIGS. 3-5, a process for cleaning articles using the warewash machine 100 according to an embodiment of the present invention is described with reference to the various warewash components shown in FIG. 2. This process is referred to herein as a "cleaning process" and identified in FIGS. 3 and 5 using reference numeral 300. FIG. 3 is a graphical representation depicting the timing and sanitation levels associated with the phases of the cleaning process 300. FIG. 4 is a timing diagram 400 illustrating operation states of the wash arms pump 162, the pump diverter 160, the sump diverter 152, the wash module 106, the rinse module 102 and the final rinse pump 168 during each of the phases depicted in the graphical representation of FIG. 3. FIG. 5 is a flow diagram illustrating the operational flow of the phases of the cleaning process 300.

In accordance with an embodiment of the present invention, operation of the warewash machine 100 to perform the cleaning process 300 is controlled and monitored by the controller 112. As such, the controller 112 controls the rinse module 102, the wash module 106, the wash arms pump 162, the pump diverter 160, the sump diverter 152 and the final rinse pump 168 in administration of the cleaning process 300 by the warewash machine 100 in accordance with this embodiment.

As noted in the introduction to the Detailed Description above, the cleaning process 300 begins with a wash phase 303, then continues to an auxiliary rinse phase 305 and concludes with a final rinse phase 306. The length of time during which each of these phases 303, 305 and 306 occur within the cleaning process 300 may be dependent on many factors, such as, without limitation, targeted sanitation level, targeted water usage, targeted energy usage and the expected soil level on the articles being cleaned by the machine 100. For example, the standards and regulations described above typically require that the cleaning process reach a minimum HUE corresponding to a required sanitation level. For illustration purposes only, the wash phase 303 is shown in FIGS. 3 and 4 to last approximately 38 seconds, the auxiliary rinse phase 305 is shown in FIGS. 3 and 4 to last approximately 13 seconds and the final rinse phase 306 is shown in FIGS. 3 and 4 to last approximately 5 seconds. Based on the length of these time periods, it is contemplated that the sanitation level of the cleaning process 300 will reach approximately 3500 HUEs, as shown in FIG. 3. Those skilled in the art will appreciate that combinations of numerous other time periods and HUE levels for each of these phases are contemplated within the scope of the present invention.

As noted in FIGS. 3-5, a dwell period 304 occurs between the wash phase 303 and the auxiliary rinse phase 305 in accordance with an exemplary embodiment of the present invention. The dwell period 304 is a brief time period during the cleaning process 300 when neither the wash module 106 nor the rinse module 102 dispense an agent to the wash chamber 108. Instead, the dwell period 304 represents an idle time during which the cleaning agent that was dispensed to the wash chamber 108 during the wash phase 303 settles to the bottom of the wash chamber 108 and flows via the sump diverter 152 into the wash sump 146.

In an exemplary embodiment, a single cleaning process 300 is characterized by a flow of controller-implemented operations (hereinafter, "operation flow") beginning with a start operation 301 and ending with a finish operation 307, as shown in FIG. 5. The start operation 301 is initiated in response to a user's request for the warewash machine 100 to clean one or more articles input into the wash chamber 108. For example, the user may depress a start button or other activation control presented on the user interface 122. Prior to starting the wash phase 303, the operation flow passes to a query operation 302.

The query operation 302 provides a loop within the operation flow that determines when the wash phase 303 is to be initiated. The query operation 302 makes this determination by monitoring whether certain initial conditions related to performance of the cleaning process 300 are satisfied. The initial conditions represent thresholds that have been predetermined to provide satisfactory results by the warewash machine 100. Examples of these initial conditions may be, without limitation, the temperature of the cleaning agent in the wash sump 146 being within a predetermined range, the temperature of the auxiliary rinse agent in the auxiliary rinse sump 148 being within a predetermined range, the temperature of the final rinse agent in the final rinse sump 150 being within a predetermined range and the concentration of the chemical product dissolved in the cleaning agent being within a predetermined range. In response to determining that each of the initial conditions are satisfied, the query operation 302 passes the operation flow to the wash phase 303, thereby triggering initiation of the wash phase 303. The actual initial conditions monitored by the query operation 302 in order to determine when to trigger initiation of the wash phase 303 are a matter of implementation chosen by the operator of the warewash machine 100. In an embodiment, these initial conditions are selected based on the minimum temperature thresholds defined by the National Standards Foundation.

In accordance with the exemplary embodiment illustrated in FIGS. 3 and 4, the wash phase 303 begins at time t=0 seconds and lasts until approximately time t=38 seconds. Thus, either before or at time t=0 seconds, the controller 112 sets the pump diverter 160 to direct cleaning agent from the wash sump 146 to the wash arms pump 162. Also at time=0 seconds, the controller 112 activates the wash arms pump 162 to pump cleaning agent from the wash sump 146 to the wash module 106. In receipt of the cleaning agent, the wash module 106, which is activated by the controller 112 at time t=0 seconds, dispenses the cleaning agent into the wash chamber 108 for application thereof to the articles situated therein. During the entirety of the wash phase 303, the final rinse pump 168 and the rinse module 102 are maintained in the "off" state.

Also, at time t=0 seconds, the controller 112 sets the sump diverter 152 to direct cleaning agent dispensed into the wash chamber 108 to the wash sump 146. Therefore, cleaning agent that has been pumped from the wash sump 146 to the wash module 106 during the wash phase 303 returns to the wash sump 146 and, may indeed, be forced back through the wash arms pump 162 and back into the wash chamber 108 via the wash module 106 during a single wash phase 303. At time t=38 seconds, the wash phase 303 is completed and the operation flow of the cleaning process 300 continues to the dwell period 304.

During the dwell period 304, the controller 112 de-activates the wash arms pump 162 and the wash module 106 and maintains the final rinse pump 168 and the rinse module 102 in the "off" state. Also, the controller 112 maintains the sump diverter 152 in the same position as during the wash phase 303 such that any cleaning agent remaining in the wash chamber 108 at the conclusion of the wash phase 303 is directed into the wash sump 146. At some time during the dwell period 304, the controller 112 switches the pump diverter 160 to direct auxiliary rinse agent from the auxiliary rinse sump 148 to the wash arms pump 162 in preparation for the auxiliary rinse phase 305. As shown in the exemplary embodiment illustrated in FIG. 4, this particular time occurs approximately 2 seconds into the dwell period 304 (i.e., at time t=40 seconds).

In an embodiment, the dwell period 304 lasts for a length in time necessary for the cleaning agent remaining in the wash chamber 108 at the conclusion of the wash phase 303 to settle to the bottom of the chamber 108 and flow via the sump diverter 152 into the wash sump 146. An exemplary time is shown in FIGS. 3 and 4 to be approximately 4 seconds. Thus, at time t=42 seconds, the dwell period 304 ends and the operation flow of the cleaning process 300 proceeds to the auxiliary rinse phase 305.

At the initiation of the auxiliary rinse phase 305, the pump diverter 160 is currently set to direct auxiliary rinse agent from the auxiliary rinse sump 148 to the wash arms pump 162 and the final rinse pump 168 and the rinse module 102 are both currently in the "off" state. The controller 112 maintains these components in these states during the entire duration of the auxiliary rinse phase 305. In accordance with the exemplary embodiment illustrated in FIGS. 3 and 4, the auxiliary rinse phase 305 begins at time t=42 seconds and lasts until approximately time t=55 seconds. At time t=42 seconds, the controller 112 initiates the wash arms pump 162, which pumps the auxiliary rinse agent from the auxiliary rinse sump 148 (by virtue of the pump diverter 160 setting) to the wash module 106 via the pump-module conduit 166. In receipt of the auxiliary rinse agent, the wash module 106, which is also activated by the controller 112 at time t=42 seconds, dispenses the auxiliary rinse agent into the wash chamber 108 for application thereof to the articles situated therein.

For a predetermined period in time beginning at the initiation of the auxiliary rinse phase 305, the controller 112 maintains the sump diverter 152 in a position such that the auxiliary rinse agent dispensed into the wash chamber 108 by the wash module 106 is directed to the wash sump 146. As such, at least a portion of the cleaning agent contained in the wash sump 146 is replaced with the auxiliary rinse agent provided to the sump 146 directly by the sump diverter 152. At the conclusion of this predetermined period in time, the controller 112 sets the sump diverter 152 to direct the auxiliary rinse agent dispensed into the wash chamber 108 to the auxiliary rinse sump 148. The length of this predetermined period in time is a matter of choice for the warewash operator, but is shown in an exemplary manner in FIGS. 3 and 4 to last for approximately 4 seconds. Therefore, the controller 112 sets the sump diverter 152 to direct the auxiliary rinse agent dispensed into the wash chamber 108 to the auxiliary rinse sump 148 for the duration of the auxiliary rinse phase 305.

At time t=55 seconds, the auxiliary rinse phase 305 is completed and the operation flow of the cleaning process 300 continues to the final rinse phase 306. At this time, the controller 112 deactivates the wash module 106 and the wash arms pump 160, therefore setting these components to the "off" state. Concurrently, the controller 112 activates the final rinse pump 168 to pump the final rinse agent from the final rinse sump 150 to the rinse module 102.

In receipt of the final rinse agent, the rinse module 102, which is also activated by the controller 112 at time t=55 seconds, dispenses the final rinse agent into the wash chamber 108 for application thereof to the articles situated therein. Additionally, the controller 112 maintains the setting of the sump diverter 152 in a position such that the final rinse agent dispensed into the wash chamber 108 is directed to the auxiliary rinse sump 148. As such, at least a portion of the auxiliary rinse agent contained in the auxiliary rinse sump 148 is replaced with the final rinse agent provided to the sump 148 directly by the sump diverter 152. Because the wash arms pump 162 is maintained in the "off" state during the final rinse phase 306, the setting of the pump diverter 160 is irrelevant, and as such, shown in dashed lines in FIG. 4. At approximately time t=60 seconds, the final rinse phase 306 is completed and the operation flow of the cleaning process 300 concludes at the finish operation 307.

Figure 6:
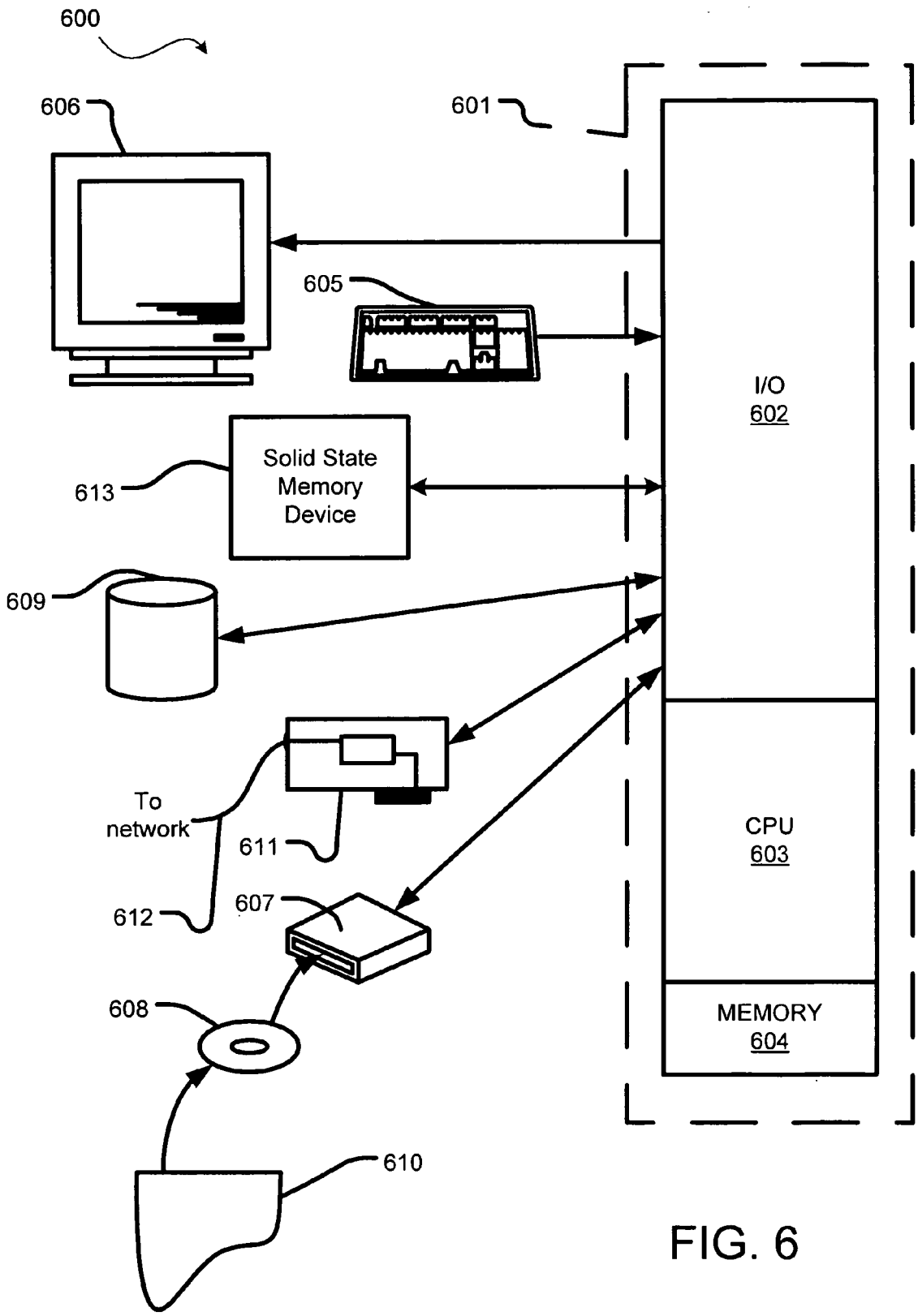
FIG. 6 depicts a block diagram of a suitable computing environment in which embodiments of the present invention, such as, for example, the processes shown in FIGS. 5 and 6, may be implemented.

FIG. 6 depicts a computing system 600 capable of executing a program product embodiment of the present invention. One operating environment in which the present invention is potentially useful encompasses a computing system 600 that includes, for example, the GUI 122, the warewash controller 112 and any components controlled and/or monitored by the controller 112, or a remote computer to which information collected by the warewash controller 112 may be uploaded. In such a system, data and program files may be input to the computing system 600, which reads the files and executes the programs therein. Some of the elements of a computing system 600 are shown in FIG. 6 wherein a controller 112 (e.g., warewash controller 112), which is illustrated as a processor 601, is shown having an input/output (I/O) section 602, a microprocessor, or Central Processing Unit (CPU) 603, and a memory section 604. The present invention is optionally implemented in software or firmware modules loaded in memory 604 and/or stored on a solid state, non-volatile memory device 613, a configured CD-ROM 608 or a disk storage unit 609. As such, the computing system 600 is used as a "special-purpose" machine for implementing the present invention.

The I/O section 602 is connected to a user input module 605, e.g., a keyboard, a display unit 606 and one or more program storage devices, such as, without limitation, the solid state, non-volatile memory device 613, the disk storage unit 609, and the disk drive unit 607. The user input module 605 is shown as a keyboard, but may also be any other type of apparatus for inputting commands into the processor 601. The solid state, non-volatile memory device 613 is an embedded memory device for storing instructions and commands in a form readable by the CPU 603. In accordance with various embodiments, the solid state, non-volatile memory device 613 may be Read-Only Memory (ROM), an Erasable Programmable ROM (EPROM), Electrically-Erasable Programmable ROM (EEPROM), a Flash Memory or a Programmable ROM, or any other form of solid state, non-volatile memory. In accordance with one embodiment, the disk drive unit 607 is a CD-ROM driver unit capable of reading the CD-ROM medium 608, which typically contains programs 610 and data. Computer program products containing mechanisms to effectuate the systems and methods in accordance with the present invention may reside in the memory section 604, the solid state, non-volatile memory device 613, the disk storage unit 609 or the CD-ROM medium 608.

In accordance with an alternative embodiment, the disk drive unit 607 may be replaced or supplemented by a floppy drive unit, a tape drive unit, or other storage medium drive unit. A network adapter 611 is capable of connecting the computing system 600 to a network of remote computers via a network link 612. Examples of such systems include SPARC systems offered by Sun Microsystems, Inc., personal computers offered by IBM Corporation and by other manufacturers of IBM-compatible personal computers, and other systems running a UNIX-based or other operating system. A remote computer may be a desktop computer, a server, a router, a network PC (personal computer), a peer device or other common network node, and typically includes many or all of the elements described above relative to the computing system 600. Logical connections may include a local area network (LAN) or a wide area network (WAN). Such networking environments are commonplace in offices, enterprise-wide computer networks, intranets, and the Internet.

In accordance with a program product embodiment of the present invention, software instructions stored on the solid state, non-volatile memory device 613, the disk storage unit 609, or the CD-ROM 608 are executed by the CPU 603. In this embodiment, these instructions may be directed toward communicating data between the controller 112 and a remote computer and analyzing data, such as, without limitation, environmental parameters and operational settings, to set up and/or control operation of the controller 112. Data, such as environmental parameters and operational settings, may be stored in memory section 604, or on the solid state, non-volatile memory device 613, the disk storage unit 609, the disk drive unit 607 or other storage medium units coupled to the system 600.

In accordance with one embodiment, the computing system 600 further comprises an operating system and usually one or more application programs. Such an embodiment is familiar to those of ordinary skill in the art. The operating system comprises a set of programs that control operations of the computing system 600 and allocation of resources. The set of programs, inclusive of certain utility programs, also provide a graphical user interface to the user. An application program is software that runs on top of the operating system software and uses computer resources made available through the operating system to perform application specific tasks desired by the user. In accordance with an embodiment, the operating system employs a graphical user interface (e.g., 122) wherein the display output of an application program is presented in a rectangular area on the selection screen (e.g., 903) of the display device 606. The operating system is operable to multitask, i.e., execute computing tasks in multiple threads, and thus may be any of the following: Microsoft Corporation's "WINDOWS 95," "WINDOWS CE," "WINDOWS 98," "WINDOWS 6000" or "WINDOWS NT" operating systems, IBM's OS/2 WARP, Apple's MACINTOSH OSX operating system, Linux, UNIX, etc.

In accordance with the practices of persons skilled in the art of computer programming, the present invention is described below with reference to acts and symbolic representations of operations that are performed by the warewash controller 112 or a remote computer communicating therewith, unless indicated otherwise. Such acts and operations are sometimes referred to as being computer-executed or computer-implemented. It will be appreciated that the acts and symbolically represented operations include the manipulations by the CPU 603 of electrical signals representing data bits causing a transformation or reduction of the electrical signal representation, and the maintenance of data bits at memory locations in the memory 604, the solid state, non-volatile memory device 613, the configured CD-ROM 608 or the storage unit 609 to thereby reconfigure or otherwise alter the operation of the computing system 600, as well as other processing signals. The memory locations where data bits are maintained are physical locations that have particular electrical, magnetic, or optical properties corresponding to the data bits.

The logical operations of the various embodiments of the present invention are implemented either manually and/or (1) as a sequence of computer-implemented steps running on the warewash controller 112, and/or (2) as interconnected machine modules within the controller 112. The implementation is a matter of choice dependent on the performance requirements of the computing system implementing the invention. Accordingly, the logical operations making up the embodiments of the present invention described herein are referred to alternatively as operations, acts, steps or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

It will be clear that the present invention is well adapted to attain the ends and advantages mentioned, as well as those inherent therein. While a presently preferred embodiment has been described for purposes of this disclosure, various changes and modifications may be made which are well within the scope of the present invention. For example, the warewash controller 112 is illustrated as being a "smart" controller 112 that is operable to control all components and operations of the warewash machine 100. Alternatively, more than one controller 112 may be used to control different components and operations of the machine 100.

Further, the warewash controller 112 may connect to a communications network 800 by way of a network interface, such as the network adapter 211 shown in FIG. 6. Through this network connection, the controller 112 is operable to transmit information to one or more remote computers, such as, without limitation, a server computer or user terminals. Various types of information may be transmitted from the controller 112 to these remote computers over the network connection including, without limitation, the various environmental and operational settings described herein. In addition, the network adaptor 211 enables users at remote computers the ability to issue commands to the controller 112. For example, a user at a remote computer may modify the conductivity setpoint using this network connection.

Numerous other changes may be made which will readily suggest themselves to those skilled in the art and which are encompassed in the spirit of the invention disclosed and as defined in the appended claims.

What is claimed is:

1. A method for cleaning articles within a chamber of a wash machine, the wash machine having a rinse sump for collecting rinse agents dispensed into the chamber and a wash sump for collecting wash agents dispensed into the chamber, wherein the method comprises:

dispensing a wash agent into the chamber during a wash phase;

controlling a controllable deflector to direct the wash agent to the wash sump during the wash phase;

dispensing a rinse agent into the chamber during an auxiliary rinse phase;

controlling the controllable deflector to direct the rinse agent to the wash sump for a predetermined period in time after initiation of the auxiliary rinse phase;

controlling the controllable deflector to direct the rinse agent to the rinse sump after the predetermined period in time and for the remaining duration of the auxiliary rinse phase;

accepting water from a source external to the wash machine and dispensing the water into the chamber during a final rinse phase;

controlling the controllable deflector to direct the water dispensed during the final rinse phase to the rinse sump such that the water combines with the rinse agent; and re-using the rinse agent in the rinse sump during at least one subsequent auxiliary rinse phase; wherein the wash sump and the rinse sump are separate sumps.

2. A method as defined in claim 1, wherein the wash agent is formed by combining at least one chemical product with water in the wash sump, the act of dispensing the wash agent comprising:

pumping the wash agent from the wash sump into the chamber.

3. A method as defined in claim 2, further comprising:

prior to the act of dispensing the wash agent into the chamber, determining whether at least one initial condition is satisfied, wherein the at least one initial condition relates to a threshold parameter associated with satisfaction of results of the cleaning method.

4. A method as defined in claim 3, wherein the threshold parameter relates to a minimum temperature of the wash agent.

5. A method as defined in claim 3, wherein the threshold parameter relates to a minimum temperature of the rinse agent.

6. A method as defined in claim 3, wherein the wash agent comprises at least one chemical product and water, the threshold parameter relating to a concentration level of the at least one chemical product in the wash agent.

7. A method as defined in claim 2, further comprising:

heating the wash agent contained in the wash sump to a predetermined temperature; and initiating the wash phase when the temperature of the wash agent in the wash sump reaches the predetermined temperature such that the temperature of the wash agent serves as a condition for initiating the act of dispensing the wash agent into the chamber.

8. A method as defined in claim 7, further comprising:

heating the rinse agent contained in the rinse sump to a predetermined temperature; and initiating the wash phase when the temperature of the rinse agent in the rinse sump reaches the predetermined temperature such that the temperatures of the rinse agent and the wash agent both serve as a condition for initiating the act of dispensing the wash agent into the chamber.

9. A method as defined in claim 2, wherein the act of dispensing the rinse agent into the chamber during the auxiliary rinse phase comprises:

pumping the rinse agent from the rinse sump into the chamber.

10. A computer readable storage medium comprising instructions, the instructions causing a processor to:

dispense a wash agent into a chamber of a wash machine during a wash phase;

control a controllable deflector to direct the wash agent to a wash sump during the wash phase;

dispense a rinse agent into the chamber during an auxiliary rinse phase;

control the controllable deflector to direct the rinse agent to the wash sump for a predetermined period in time after initiation of the auxiliary rinse phase;

control the controllable deflector to direct the rinse agent to a rinse sump after the predetermined period in time and during the remaining duration of the auxiliary rinse phase;

accept water from a source external to the wash machine and dispense the water into the chamber during a final rinse phase;

control the controllable deflector to direct the water dispensed during the final rinse phase to the rinse sump such that the water combines with the rinse agent; and re-use the rinse agent in the rinse sump during at least one subsequent auxiliary rinse phase; wherein the wash sump and the rinse sump are separate sumps.

* * * * *